US005641970A

United States Patent [19]

Taniuchi et al.

[11] Patent Number: 5,641,970

[45] Date of Patent: Jun. 24, 1997

[54] TRANSPORT/STORAGE CASK FOR A RADIOACTIVE MATERIAL

[75] Inventors: Hiroaki Taniuchi; Kenichi Mantani, both of Takasago, Japan

[73] Assignee: Kabushiki Kaisha Kobe Seiko Sho, Kobe, Japan

[21] Appl. No.: 691,319

[22] Filed: Aug. 2, 1996

[30] Foreign Application Priority Data

Aug. 4, 1995 [JP] Japan ..... 7-199594

[51] Int. Cl.[6] ..... G21F 5/00

[52] U.S. Cl. ..... 250/506.1; 250/507.1; 376/272

[58] Field of Search ..... 250/506.1, 507.1, 250/505.1; 376/272; 976/DIG. 341–344; 588/1, 16

[56] References Cited

U.S. PATENT DOCUMENTS

| | | | |
|---|---|---|---|
| 3,780,306 | 12/1973 | Anderson et al. | 250/506.1 |
| 3,930,166 | 12/1975 | Bochard | 250/506.1 |
| 4,535,250 | 8/1985 | Fields | 250/507.1 |

FOREIGN PATENT DOCUMENTS

| | | |
|---|---|---|
| 0 036 954 | 10/1981 | European Pat. Off. . |
| 2 471 027 | 6/1981 | France . |
| 2 471 028 | 6/1981 | France . |
| 2 471 029 | 6/1981 | France . |
| 40 32 343 | 4/1992 | Germany . |
| 61-198099 | 9/1986 | Japan . |
| 63-159798 | 7/1988 | Japan . |

OTHER PUBLICATIONS

Patent Abstracts of Japan, vol. 950, No. 1, and Derwent Abstracts, AN–95 102560, JP–A 07 027896, Jan. 31, 1995.

*Primary Examiner*—Jack I. Berman
*Assistant Examiner*—Kiet T. Nguyen
*Attorney, Agent, or Firm*—Oblon, Spivak, McClelland, Maier & Neustadt, P.C.

[57] ABSTRACT

A transport/storage cask for a radioactive material has an inner shell and an outer shell, and between the two shells, a gamma ray shielding layer and a neutron shielding layer are provided. The transport/storage cask also includes heat-conductive members which are provided so as to penetrate through the gamma ray shielding layer and the neutron shielding layer. The transport/storage cask for a radioactive material is capable of containing a radioactive material at an enhanced efficiency, exhibits excellent heat-conductive performance, and effectively shields gamma rays and neutrons.

4 Claims, 3 Drawing Sheets

TRANSPORT/STORAGE CASK FOR A RADIOACTIVE MATERIAL

BACKGROUND OF THE INVENTION

1. Field of the Invention

The present invention relates to a transport/storage cask for a radioactive material such as spent fuel or the like.

2. Description of the Related Art

A transport/storage cask for a radioactive material such as spent fuel or the like from a nuclear power plant or the like is adapted to effectively dissipate heat generated through the decay of a radioactive material such as spent fuel or the like contained therein and to shield gamma rays and neutrons emitted from a radioactive material. Examples of such a cask are disclosed, for example, in Japanese Patent Application Laid-Open No. 7-27896 (kokai) and Japanese Patent Application Publication No. 5-39520 (kokoku).

A transport/storage cask disclosed in Japanese Patent Application Laid-Open No. 7-27896 (kokai) is composed of an inner shell made of a steel plate, an outer shell made of a steel plate, a lead layer interposed between the inner and outer shells, a neutron shield disposed on the outer surface of the outer shell, and heat radiation fins disposed on the outer surface of the neutron shield. The lead layer closely contacts the outer surface of the inner shell via a thin film of a lead-tin material so as to efficiently dissipate outward heat generated within the inner shell, such as that resulting from decay of a radioactive material. Gamma rays emitted from a radioactive material are shielded by the lad layer, and neutrons are shielded by the neutron shield. Thus, a radioactive material such as spent fuel is transported safely in the cask.

A transport/storage cask disclosed in Japanese Patent Application Publication No. 5-39520 (kokoku) is composed of a metallic cylindrical vessel, an outer shell, a plurality of metallic heat-conductive members which are disposed adjacent to each other around the vessel and between the vessel and the outer shell, and a neutron shield material filling in each of closed spaces formed by the heat-conductive members and the outer shell. Each of the heat-conductive members has an L-shaped cross-section and is composed of a portion which extends in the longitudinal direction of the vessel so as to contact the outer surface of the vessel and a portion which extends in the radial direction of the vessel and whose end is attached to the inner surface of the outer shell.

The transport/storage cask disclosed in Japanese Patent Application Laid-Open No. 7-27896 (kokai) has an advantage that the inner shell can be made thin because the lead layer having an excellent shielding capability against gamma rays is disposed between the inner and outer shells, and an advantage that heat generated within the inner shell, such as that resulting from decay of a radioactive material, can be efficiently dissipated outward because the lead layer closely contacts the outer surface of the inner shell via the thin film of a lead-tin material. However, in order to attain a close contact between the lead layer and the outer surface of the inner shell, the lead layer is formed employing a so-called homogenizing treatment comprising the steps of: applying flux containing zinc chloride, stannous chloride, and the like to the outer surface of the inner shell; coating the outer surface with molten lead-tin material; assembling the inner and outer shells together; and casting lead between the inner and outer shells. As a result, the fabrication of the cask takes a longer period of time and involves higher costs. Further, lead must be carefully cast between the inner and outer shells so as to not introduce defects such as voids, and after casting, the cask must undergo an ultrasonic inspection for such defects. Moreover, heat generated during casting causes the inner and outer shells to deform, resulting in a nonuniform clearance between the inner and outer shells and thus forming a thinner portion in the thus-cast lead layer. It is therefore necessary to cast more lead than a required quantity corresponding to a required shielding thickness.

The transport/storage cask disclosed in Japanese Patent Application Publication No. 5-39520 (kokoku) uses a vessel which is made of only carbon steel or made such that a lead layer is interposed between carbon steel layers, thereby shielding gamma rays. When the vessel is made of only carbon steel, the thickness thereof must be considerably large to shield gamma rays because carbon steel is inferior to lead in terms of gamma ray shielding capability. Even though the vessel is relatively thick, the heat-conductive performance thereof is relatively good, and thus no problem arises with respect to heat; however, the vessel's capacity for containing a radioactive material reduces accordingly, resulting in a reduced storage efficiency. When the vessel is made such that a lead layer is interposed between carbon steel layers, gamma ray shielding capability improves, but the heat-conductive performance deteriorates because it is difficult to interpose the lead layer between the carbon steel layers such that the lead layer contacts closely the carbon steel layers. In order to attain the close contact between the layers, the lead layer must be formed employing the homogenizing treatment, as described above in the paragraph of Japanese Patent Application Laid-Open No. 7-27896 (kokai), but this introduces the problem as described in the paragraph.

SUMMARY OF THE INVENTION

The present invention has been achieved to solve the above-mentioned problems. An object of the present invention is to provide a transport/storage cask for a radioactive material having a high efficiency of storing a radioactive material, an excellent heat-conductive performance, and a high capability of effectively shielding gamma rays and neutrons.

In order to attain the above objective, the transport/storage cask for a radioactive material according to the present invention has a gamma ray shielding layer and a neutron shielding layer disposed around an inner shell, as well as heat-conductive members penetrating through the layers.

In this transport/storage cask for a radioactive material, the gamma ray shielding layer and the neutron shielding layer may comprise blocks that are disposed along the longitudinal direction of the inner shell and around the circumferential direction of the inner shell while a heat-conductive member is interposed between adjacent blocks.

In this transport/storage cask for a radioactive material, each block of the gamma ray shielding layer and the neutron shielding layer may be divided into sub-blocks in the longitudinal direction thereof. Adjacent sub-blocks may be joined together via slant end surfaces or rabbets. Blocks of the gamma ray shielding layer may be of lead.

In the above-mentioned structure, gamma rays emitted from a radioactive material are shielded by the gamma ray shielding layer disposed around the inner shell, and heat resulting from decay of a radioactive material is transferred efficiently via heat-conductive members from the inner shell to the outer shell. Thus, the thickness of the inner shell can be reduced to a minimum value so long as it does not hinder the function of a pressure vessel, and the fabrication of the gamma ray shielding layer does not require a special treatment, such as the homogenizing treatment, for improving the heat-conductive performance, thereby facilitating the fabrication of the cask and reducing fabrication cost.

The transport/storage cask for a radioactive material according to the present invention can be fabricated relatively readily at low cost, contains a radioactive material at an enhanced efficiency, exhibits excellent heat-conductive performance, and effectively shields gamma rays and neutrons.

BRIEF DESCRIPTION OF THE DRAWINGS

FIGS. 4A to 4C are views illustrating a block of a gamma ray shielding layer according to the embodiment, wherein FIG. 4A is a view illustrating a block having slant ends for joint and FIGS. 4B and 4C are views illustrating a block having rabbeted ends for joint.

DESCRIPTION OF THE PREFERRED EMBODIMENTS

Figure 1:
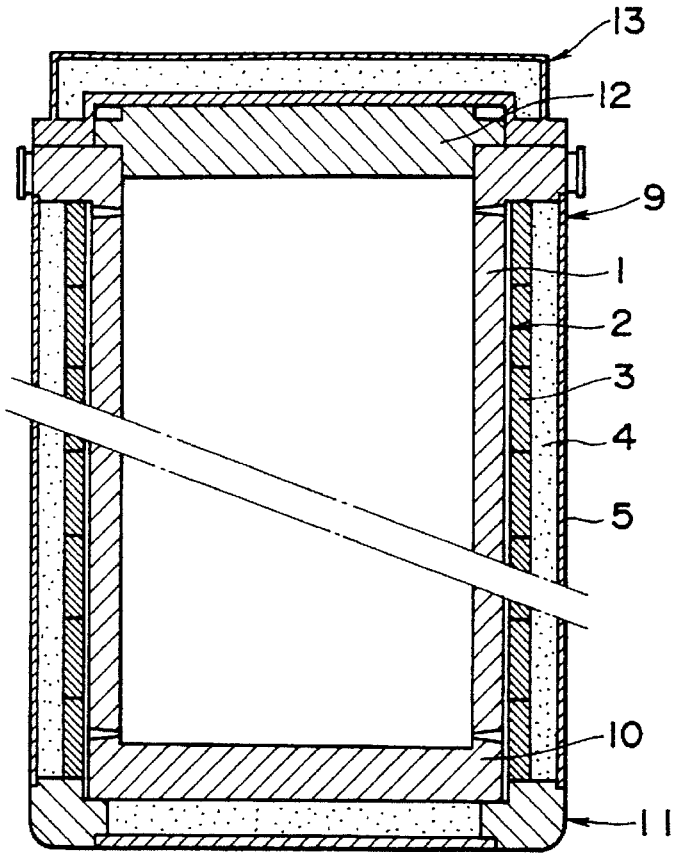
FIG. 1 is a longitudinal cross-section of a transport/storage cask for a radioactive material according to an embodiment of the present invention.
Figure 2:
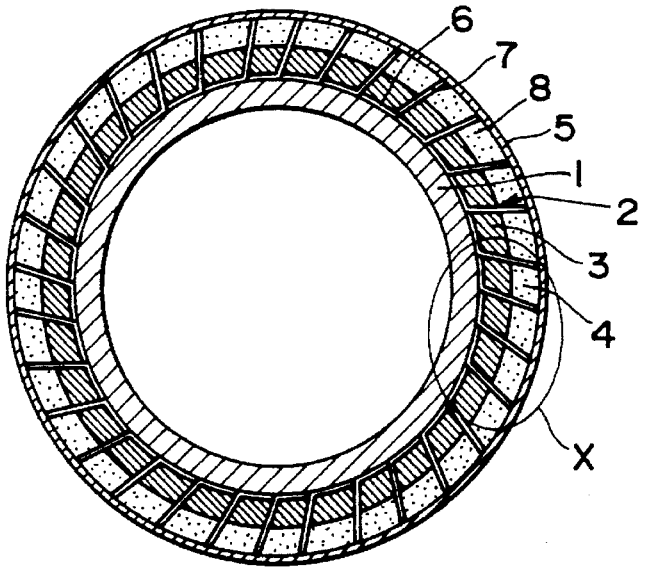
FIG. 2 is a transverse cross-section of the cask of FIG. 1.
Figure 3:
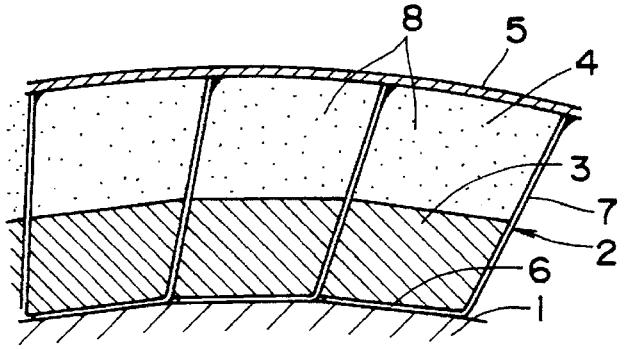
FIG. 3 is an enlarged view of portion X of FIG. 2.

An embodiment of the present invention will next be described with reference to the drawings. In FIGS. 1 to 3, reference numeral 1 denotes an inner shell, reference numeral 2 denotes heat-conductive members, reference numeral 3 denotes a gamma ray shielding layer, reference numeral 4 denotes a neutron shielding layer, and reference numeral 5 denotes an outer shell.

The inner shell 1 and the outer shell 5 are made of steel and cylindrical, and the inner diameter of the outer shell 5 is greater by a predetermined value than the outer diameter of the inner shell 1. The inner shell 1 has a minimum thickness required to function as hermetically sealed vessel. By adopting a minimum required thickness, the efficiency of storing a radioactive material is improved, and the weight of the transport/storage cask can be reduced.

Each of the heat-conductive members 2 is formed by bending a metallic sheet, such as that of copper or aluminum, having good heat conductivity into a relatively elongated shape having an L-shaped cross-section. The heat-conductive members 2 are disposed around the inner shell 1 in the following manner: side portions 6 of the L-shaped cross-sections are arranged at a predetermined pitch along the outer circumference of the inner shell 1; a surface extending longitudinally from each side portion 6 contacts the outer surface of the inner shell 1 under pressure; and the end of another side portion 7 is welded to the inner surface of the outer shell 5. As a result, a space 8 is defined by the inner shell 1, the outer shell 5, and the side portions 7. Heat generated within the inner shell 1 is transferred efficiently to the outer shell 5 via the heat-conductive members 2, and dissipated outwardly from the outer shell 5. Instead of being contacted to the outer surface of the inner shell 1 under pressure, the surface extending longitudinally from the side portion 6 may be contacted closely to the outer surface by bolting, brazing, or the like.

The gamma ray shielding layer 3 is formed of lead blocks, each having a thickness required to shield gamma rays. Each lead block has a cross-sectional shape to fit into a corresponding portion, located adjacently to the outer surface of the inner shell 1, of the space 8. The lead blocks are inserted into the space 8 along the outer surface of the inner shell 1.

The neutron shielding layer 4 is formed of resin blocks, each having a thickness required to shield neutrons. Each resin block has a cross-sectional shape to fit into a corresponding portion, located adjacently to the inner surface of the outer shell 5, of the space 8. The resin blocks are inserted into the space 8 between the gamma ray shielding layer 3 and the inner surface of the outer shell 5.

At the bottom opening of a cylindrical vessel body 9 having the above-mentioned structure, an inner bottom 10 made of the same material as that of the inner shell 1 is welded to the inner shell 1, and an outer bottom (protective bottom) 11 is mounted so as to cover the inner bottom 10. At the top opening of the cylindrical vessel body 9, an inner lid 12 made of the same material as that of the inner shell 1 or of stainless steel or the like is mounted, and an outer lid (protective cover) 13 is mounted so as to cover the inner lid 12.

In the transport/storage cask for a radioactive material having the above-mentioned structure, gamma rays emitted from a radioactive material contained within the vessel are shielded by the gamma ray shielding layer 3 disposed outside the inner shell 1. Thus, the inner shell 1 may have a minimum thickness required to function as a pressure vessel, thereby improving the efficiency of storage of a radioactive material. Since the heat-conductive members 2 penetrate through the gamma ray shielding layer 3 and the neutron shielding layer 4 and extend from the inner shell 1 to the outer shell 5, heat resulting from decay of a radioactive material contained within the vessel is transferred efficiently via the heat-conductive elements 2 from the inner shell 1 to the outer shell 5. Thus, it is not necessary to improve the heat-conductive performance of the gamma ray shielding layer 3 by a special treatment such as the homogenizing treatment, thereby facilitating the fabrication of the cask and reducing fabrication cost.

The gamma ray shielding layer 3 and the neutron shielding layer 4 can be formed of blocks, which are inserted into the spaces 8. In this case, it is not necessary to cast, at a shop, the materials of the gamma ray shielding layer 3 and the neutron shielding layer 4, but blocks of the layers can be previously produced at a dedicated casting shop. This is suited for mass production and facilitates the work of forming the gamma ray shielding layer 3 and the neutron shielding layer 4, thereby reducing fabrication cost.

Figure 4A:
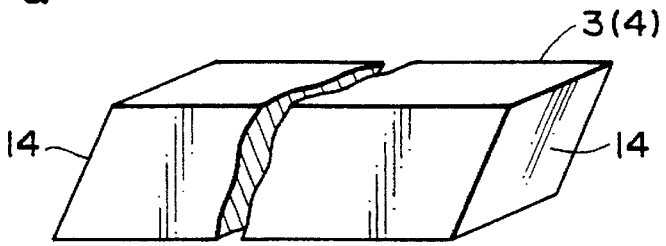
Figure 4B:
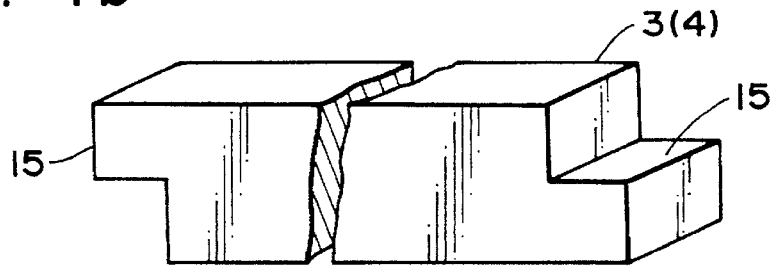
Figure 4C:
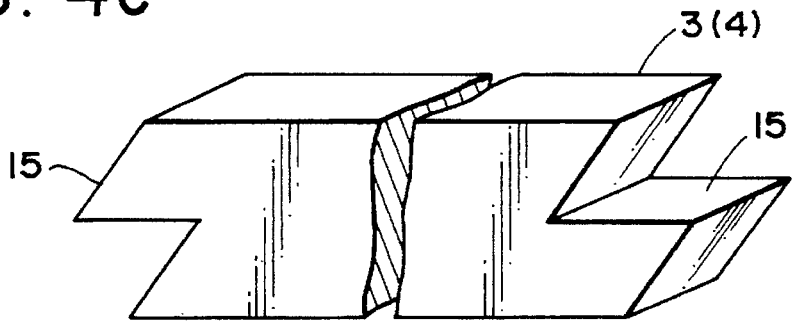

Each block of the gamma ray shielding layer 3 and the neutron shielding layer 4 can be divided in the longitudinal direction thereof into sub-blocks, each having a predetermined length. In this case, since the length of sub-blocks is shorter than that of blocks, sub-blocks are more readily produced at the above-mentioned dedicated casting shop. In order to prevent the streaming of radiation, a longitudinal end of each sub-block must have a slant surface 14 as shown in FIG. 4A or a rabbeted surface 15 as shown in FIGS. 4B and 4C.

According to the embodiment described above, the vessel body 9 is cylindrical. The present invention is not limited thereto, but the vessel body 9 may have a rectangular or polygonal shape.

Figure 5:
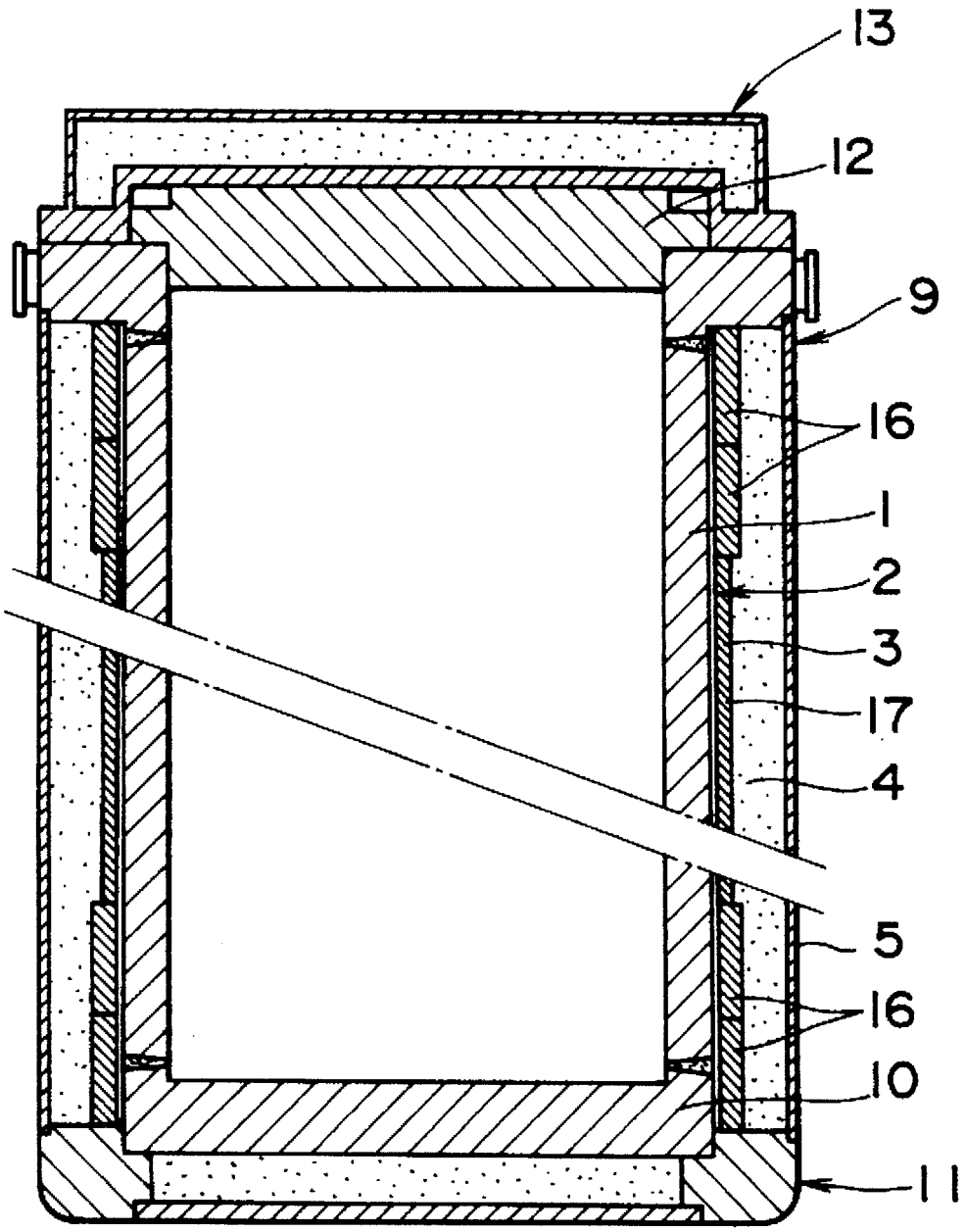
FIG. 5 is a longitudinal cross-section of a transport/storage cask for a radioactive material according to another embodiment of the present invention.

According to the embodiment described above, the gamma ray shielding layer 3 and the neutron shielding layer 4 have a uniform thickness in the longitudinal direction of a vessel. The present invention is not limited thereto, but as shown in FIG. 5, upper and lower end blocks 16 may be thicker than intermediate blocks 17. When the gamma shielding layer 3 and the neutron shielding layer 4 are formed of blocks, their thickness can be varied in the longitudinal or circumferential direction of a vessel according to the distribution of radiation sources of a radioactive material contained within the vessel.

What is claimed is:

1. A transport/storage cask for a radioactive material comprising:

an inner shell, an outer shell, a gamma ray shielding layer and a neutron shielding layer which are provided between the inner shell and the outer shell, and heat-conductive members disposed so as to penetrate through the gamma ray shielding layer and the neutron shielding layer.

2. The transport/storage cask as defined in claim 1, wherein each of the gamma ray shielding layer and the neutron shielding layer is formed of blocks that are disposed along the longitudinal direction of the inner shell and around the circumferential direction of the inner shell in such a manner that each one of the heat-conductive members is interposed between adjacent blocks.

3. The transport/storage cask as defined in claim 2, wherein each block of the gamma ray shielding layer and the neutron shielding layer is divided into sub-blocks in the longitudinal direction, and adjacent sub-blocks are joined together via slant end surfaces or rabbets.

4. The transport/storage cask as defined in claim 2, wherein the blocks of the gamma ray shielding layer is of lead.

* * * * *